US006497329B1

(12) United States Patent
Johnson et al.

(10) Patent No.: US 6,497,329 B1
(45) Date of Patent: Dec. 24, 2002

(54) MERCHANDISE DISPLAY

(75) Inventors: David R. Johnson, Belvidere; David A. Allen, Rockton, both of IL (US)

(73) Assignee: Newell Operating Company, Freeport, IL (US)

( * ) Notice: Subject to any disclaimer, the term of this patent is extended or adjusted under 35 U.S.C. 154(b) by 0 days.

(21) Appl. No.: 09/696,602

(22) Filed: Oct. 25, 2000

(51) Int. Cl.[7] ..... A47F 5/00

(52) U.S. Cl. ..... 211/128.1; 211/10; 312/118; 312/234; 206/459.5

(58) Field of Search ..... 211/10, 128.1; 40/657, 124.2; 312/117, 118, 234, 234.4; 206/730, 733, 734, 459.5

(56) References Cited

U.S. PATENT DOCUMENTS

| | | | | | |
|---|---|---|---|---|---|
| D49,499 | S | * | 8/1916 | Walker | |
| 1,303,185 | A | * | 5/1919 | Eichling | |
| 1,662,637 | A | * | 3/1928 | Chase | |
| 3,892,450 | A | * | 7/1975 | Kolster et al. | 312/117 |
| 3,908,563 | A | * | 9/1975 | Eckart | 312/234.4 |
| 3,990,752 | A | * | 11/1976 | Hoffman et al. | 312/118 |
| 4,453,324 | A | * | 6/1984 | Greenberger | 40/124.4 |
| 5,018,287 | A | * | 5/1991 | Fast | 206/459.5 |
| 6,102,502 | A | * | 8/2000 | Melillo et al. | 312/234 |

OTHER PUBLICATIONS

Amerock, SUPERSpin Merchandiser, Catalog, 1999, 1 page.

Photograph of product understood to be commercially available from Amerock Corporation, Rockford, Illinois, USA, 1 page (Photograph taken on or about 1999).

Amerock, 1999 Cabinet Hardware Display Program, Catalog, 1999, 8 pages.

Photograph of product understood to be commercially available from Amerock Corporation, Rockford, Illinois, USA, 1 page (Photograph taken on or about 1994).

Photograph of product understood to be commercially available from Amerock Corporation, Rockford, Illinois, USA, 1 page (Photograph taken on or about 1995).

Photograph of product understood to be commercially available from Amerock Corporation, Rockford, Illinois, USA, 1 page (Photograph taken on or about 1996).

Photograph of product understood to be commercially available from Amerock Corporation, Rockford, Illinois, USA, 1 page (Photraph taken on or about 1997).

Photograph of product understood to be commercially available from Amerock Corporation, Rockford, Illinois, USA, 1 page (Photograph taken on or about 1998).

(List continued on next page.)

*Primary Examiner*—Robert W. Gibson, Jr.
(74) *Attorney, Agent, or Firm*—Marshall, Gerstein & Borun.

(57) ABSTRACT

A display for merchandising products is disclosed. The display includes a base panel, two side panels coupled to the base panel, and a top panel coupled to the two side panels. A plurality of display panels are disposed between the two side panels. The display panels are configured to receive products. The display panels have surface treatments. At least two display panels have different surface treatments and the different surface treatments are configured to be associated with different product lines.

37 Claims, 9 Drawing Sheets

OTHER PUBLICATIONS

Amerock, Merchandising, Catalog, 1995, 16 pages.
Belwith, A Gallery of Cabinet Hardware–In a Merchandiser No Consumer Can Resist, Catalog, 1993, 3 pages.
Belwith, A Drawer slide Program Designed to Sell, Catalog, 1993, 1 page.
Atlas Homewares, Displays, Catalog, 199X, 1 page.
Liberty Hardware, PowerPac Best–Shelf, Catalog, 1998, 1 page.
Liberty Hardware, BestValu DrawerSlide Program, Catalog, 1998, 1 page.
Liberty Hardware, BestValue Merchandising Made Easy, Catalog, 1998, 2 pages.
Laurey, Showroom Panels, Catalog, 199X, 1 page.
Belwith, Short on Space? Try Super 4 or Super 8, Catalog, 1993, 2 pages.
Belwith, An American and European Hinge Program tha's Second to None, Catalog, 1993, 2 pages.
Laurey, From 4' to 40' Laurey Offers Complete Assortments For Every Size Program Catalog, 199X, 2 pages.

* cited by examiner

MERCHANDISE DISPLAY

FIELD OF THE INVENTION

The invention relates to displays for merchandising goods. More specifically, the invention relates to displays for merchandising goods utilizing display panels that may quickly and easily be removed from the display in order to reconfigure the merchandised goods. The invention also relates to displays for merchandising goods utilizing contrasting surface treatments to distinguish the merchandised goods.

BACKGROUND OF THE INVENTION

It is known to provide a display for merchandising goods to consumers. Such displays are used to increase sales, aid consumers in the process of identifying and selecting goods, aid stores in organizing goods, and provide a receptacle for storing inventory. However, current displays tend not to be well suited for use in a dynamic market place. Many conventional displays do not permit easy changes of displays and the associated goods. Further, many conventional displays are also not suited to properly distinguish various types of goods for consumers. Current displays tend not to allow consumers to visually differentiate among various goods of differing quality, style, and price.

Accordingly, there is a need to provide a display in which the merchandised products may quickly, easily, and efficiently be reconfigured or changed on the display, thereby allowing for a quicker response time to changing consumer demands. Also, there is a need to provide a display where the consumer may more readily visually identify and differentiate the merchandised goods based on quality, style, price and other differentiating characteristics.

The teachings herein below extend to those embodiments which fall within the scope of the appended claims, regardless of whether they accomplish one or more of the above-mentioned needs.

SUMMARY OF THE INVENTION

An exemplary embodiment of the invention relates to a display for merchandising products. The display includes a base panel, two side panels coupled to the base panel, a top panel coupled to the two side panels, and a plurality of display panels disposed between the two side panels. The display panels are configured to receive products. The display panels have surface treatments. At least two display panels have different surface treatments and the different surface treatments are configured to be associated with different product lines.

Another exemplary embodiment of the invention relates to a display panel for mounting and displaying merchandised products on a display. The display panel includes a panel body configured to be removably coupled to the display and at least one retainer slidably coupled to the panel body. The retainer is configured to be coupled to the merchandised product.

Yet another exemplary embodiment of the invention relates to a display for merchandising products. The display includes a base panel, two side panels coupled to the base panel, and a top panel coupled to the two side panels. A plurality of display panels are disposed between the two side panels. The display panels have surface treatments, at least two display panels have different surface treatments. The display panels include a panel body, the panel body configured to be removably coupled to the display and at least one retainer slidably coupled to the panel body. The retainer is configured to be coupled to the merchandised product.

BRIEF DESCRIPTION OF THE DRAWINGS

The invention will become more fully understood from the following detailed description, taken in conjunction with the accompanying drawings, wherein like reference numerals refer to like elements, in which.

DETAILED DESCRIPTION OF THE PREFERRED EMBODIMENTS

Figure 1:
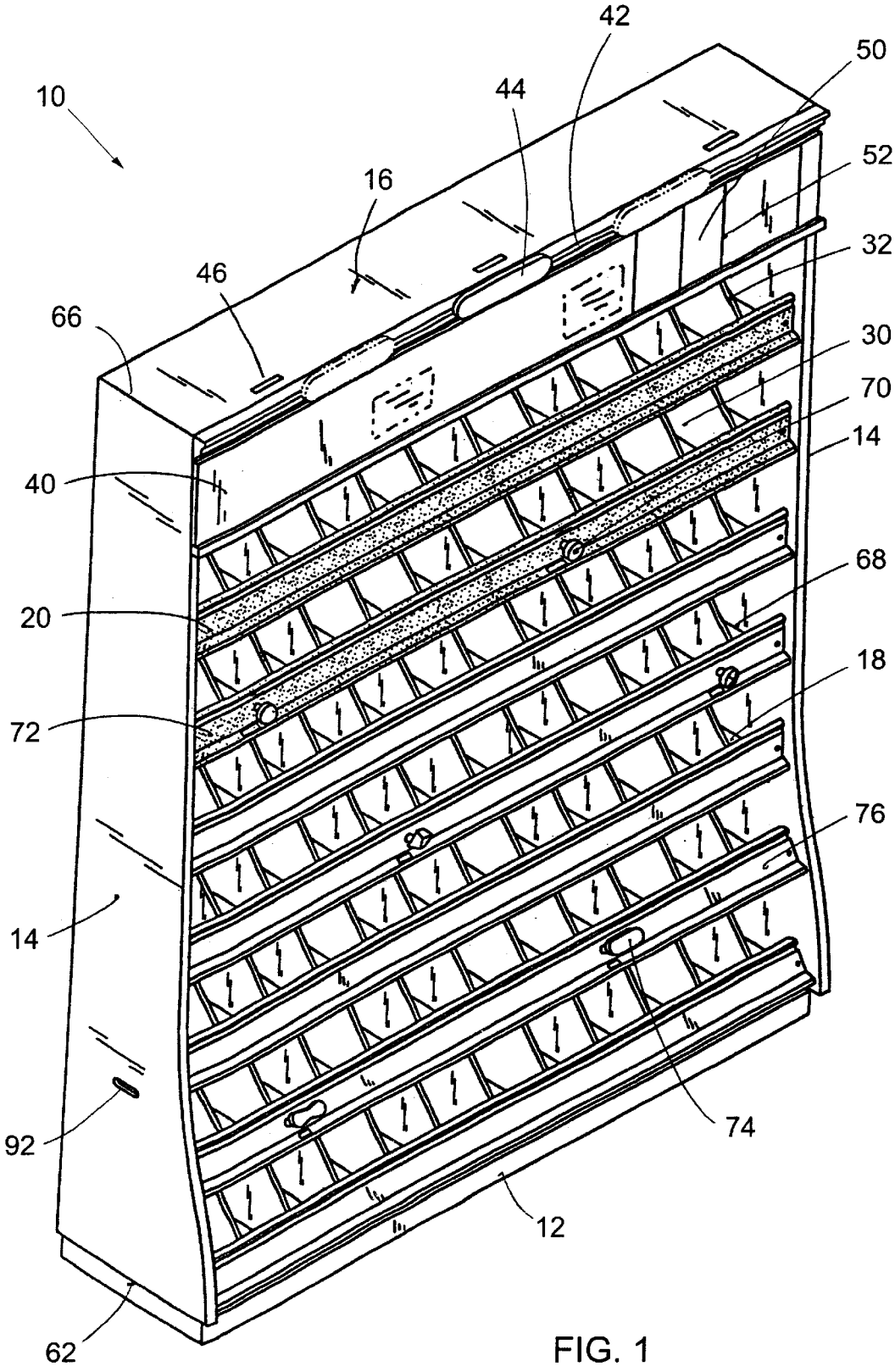
FIG. 1 is a front perspective view of an exemplary embodiment of a display.

Referring to FIG. 1, a display 10 for merchandising products is shown according to an exemplary embodiment. Display 10 includes a base panel 12. Two side panels 14, perpendicular to base panel 12, adjoin base panel 12 along base panel edges 62. A top panel 16 adjoins side panels 14 along top panel edges 66. In an exemplary embodiment, side panels 14 are connected to base panel 12 and top panel 16 by any of a variety of fastening methods including, but not limited to, screws, nails, adhesives, and the like. In an exemplary embodiment, the width of side panel 14 at base edge 62 is greater than width of side panel 14 at top edge 66 making viewing of products near the bottom of display 10 easier for customers standing near display 10. Also, in an exemplary embodiment, side panel 14 includes a handle 92 which allows display 10 to be readily moved.

Display 10 includes a plurality of shelves, configured in a vertical arrangement, shown as floor panels 18. Floor panel 18 adjoins side panel 14 at floor panel edge 68. In an exemplary embodiment, each floor panel 18 has a width proportional to the width of base panel 12 and top panel 16. Each floor panel 18 has a depth proportional to the width of side panel 14 where floor panel 18 adjoins side panel 14 along floor panel edge 68. In an exemplary embodiment, display 10 includes a total of seven (7) floor panels. The top five (5) floor panels may be of the same depth, the next lower floor panel being of greater depth, and the lowest floor panel being of greatest depth. This configuration allows a customer standing in front of display 10 to look down and identify the products stored on lower floor panels, instead of having to crouch down to see the same location. However, it should be noted that any number and arrangement of floor panels (i.e., shelves) could be used in accordance with the invention.

Display 10 includes a plurality of sales bins 30. The bottom of an exemplary sales bin 30 is bounded by floor panel 18. The sides of sales bin 30 are bounded by side walls 32. The rear of sales bin 30 is bounded by a back panel (back panel being hidden from view, or alternatively no back panel, should display 10 be mounted against a wall which may act as a back panel). The front of sales bin 30 is bounded by a display panel 20. Display panel 20 covers only the lower portion of the front of sales bin 30, allowing access to sales bin 30 while still constraining (and/or containing) the contents of sales bin 30. In an exemplary embodiment, the length of display panel 20 substantially corresponds to the width of floor panel 18, so display panel 20 is configured to bound the front of the plurality of sales bins 30 formed on the same floor panel 18.

Display 10 also includes a plurality of storage bins 50 located above the plurality of sales bins 30. The bottom of storage bin 50 is bounded by floor panel 18. The top of storage bin 50 is bounded by top panel 16. The sides of storage bin 50 are bounded by storage bin walls 52. The rear of storage bin 50 is bounded by a back panel (or wall). The front of storage bins 50 is selectively bounded by a display sign 40. This configuration provides an advantage of allowing easy restocking, i.e. excess inventory may be stored in storage bin 50 proximate to sales bin 30.

Storage bin 50 can be concealed by display sign 40. In an exemplary embodiment, display sign 40 is movably coupled to top panel 16, shown as hinges 46 (however, other types of movable couplings may be used), allowing selective access to storage bin 50. In an exemplary embodiment, display sign 40 is configured in length as to allow permanent open access to selected storage bins 50. In alternative embodiments, the display sign 40 length may be configured to cover all storage bins 50. In an exemplary embodiment, display sign 40 may be edged with crown molding 42 (alternatively, other decorative or accent moldings and/or facia may be used without departing from the scope of the invention). Display medallion 44 may be affixed to crown molding 42. Display medallion 44 may be used to affix a logo or other indicia, and may be provided in any of a variety of shapes and sizes.

Figure 2:
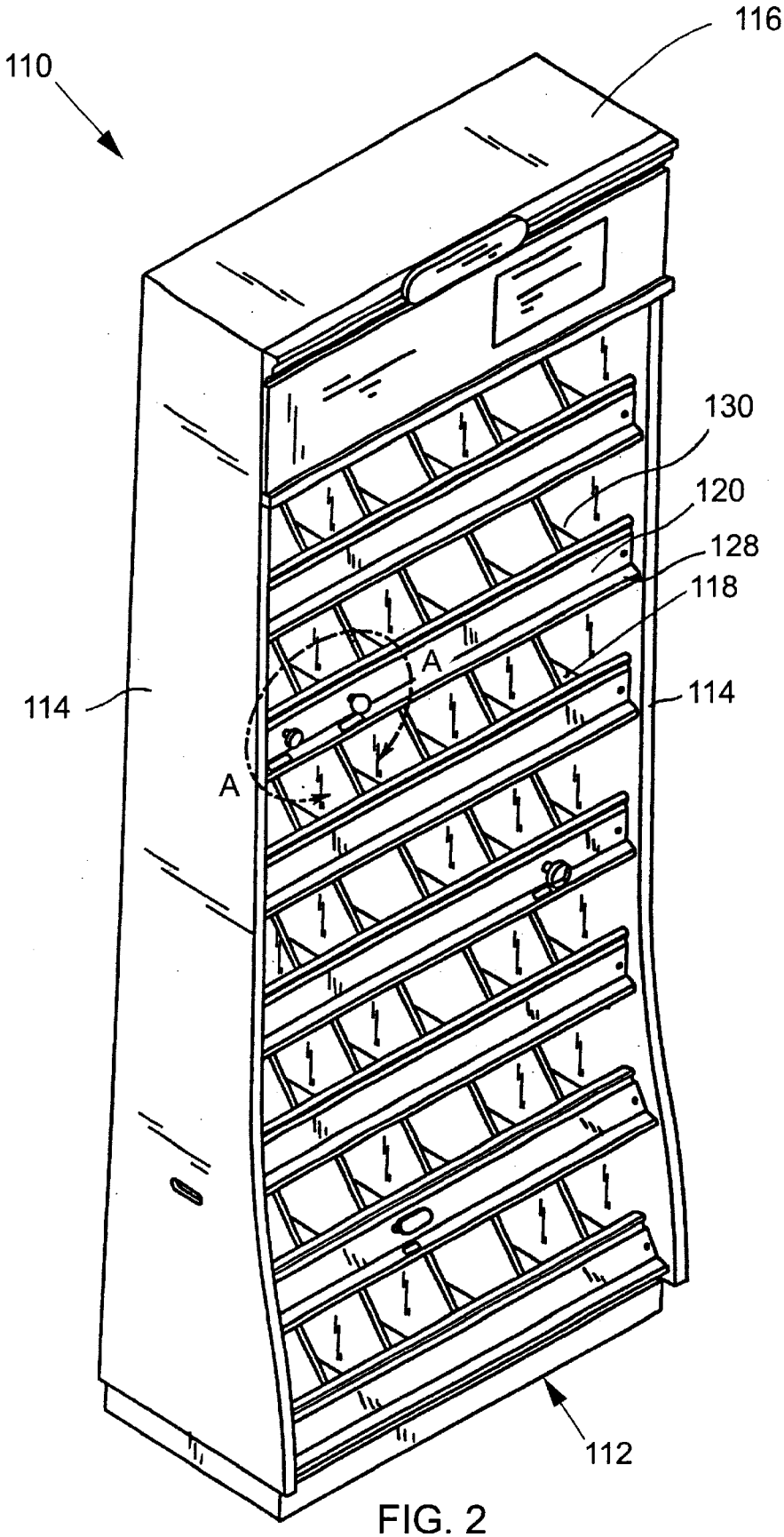
FIG. 2 is a front perspective view of an alternative embodiment of a display.

FIG. 2 depicts an alternative embodiment of a display 110. Base panel 112, top panel 116), and floor panels 118 are of lesser widths than as depicted in FIG. 1. Multiple displays of varying widths, such as those depicted in FIG. 1 and FIG. 2, may be connected in a modular fashion in order to construct an overall display of different size (and/or shape) than one single display. The smaller size of the alternative embodiment shown in FIG. 2 allows for multiple configurations, and easier reconfiguration in areas where space constraints could prevent or would hinder a larger display. Furthermore, display 110 as shown in FIG. 2 allows for increased mobility should a change in display configuration be desired.

Figure 3:
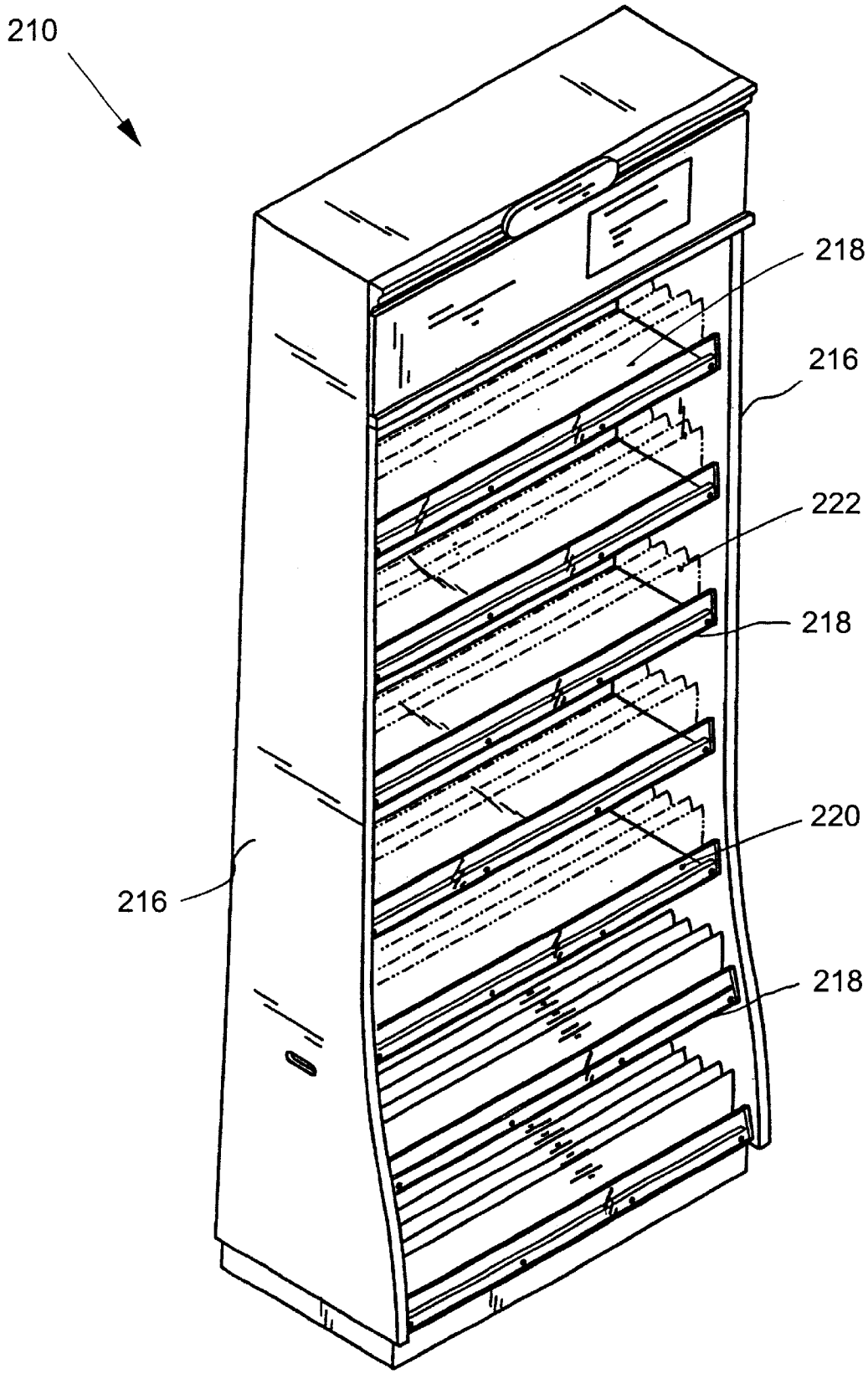
FIG. 3 is a front perspective view of another alternative embodiment of a display.

FIG. 3 depicts an alternative embodiment of a display 210, to accommodate products of greater size. Display 210 includes a plurality of substantially horizontal shelves, shown as floor panels 218, disposed between side panels 216. Display 210 includes a plurality of partitions 222, configured in a vertical arrangement, that is substantially upstanding from floor panels 218 and running substantially parallel to display panels 220. In an exemplary embodiment, partitions 222 may have a length substantially corresponding to the width of floor panel 218. The plurality of partitions 222 are arranged parallel to each other and parallel to the width of floor panel 218, disposed of along the depth of floor panel 218. This configuration provides the capability of holding larger products by utilizing the width of floor panel 218 for storage, rather than the depth of floor panel 218 for storage.

Figure 4:
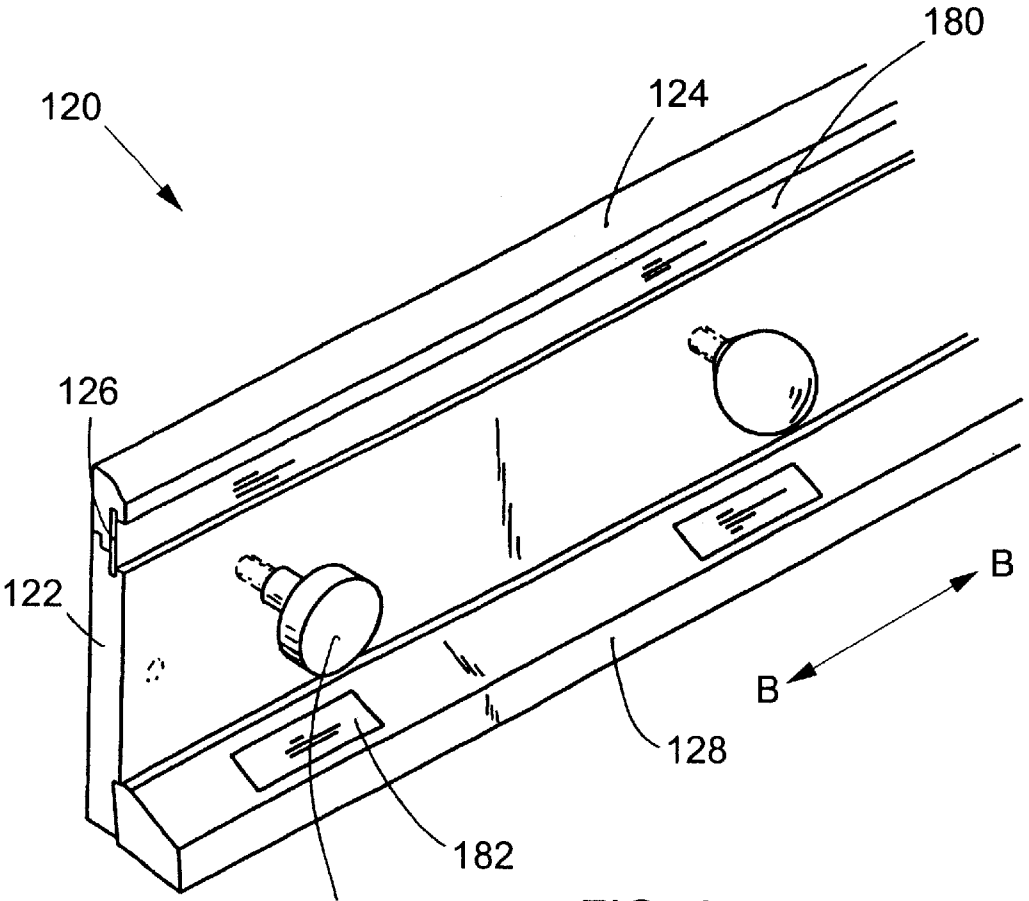
FIG. 4 is a perspective view of Section A-A of the display panel of FIG. 2.

FIG. 4 depicts Section A-A of display panel 120 of display 110, (depicted in FIG. 2) according to an exemplary embodiment. Display panel 120 includes a backer 122, an index trim 124, an index slot 126, and a ledge trim 128. Index slot 126 is suitable for holding and displaying indicia such as cards, labels, display tags, lettering, etc. depicted as index strip 180 in front of sales bin 130 to identify the contents of sales bin 130. Ledge trim 128 is suitable for holding and displaying indicia such as cards, labels, display tags, lettering, etc. depicted as label 182 in front of sales bin 130 to identify the contents of sales bin 130.

Knob 184 is mounted on backer 122 in front of sales bin 130. Knob 184 mounted on display panel 120 allows rapid and easy identification of the contents of sales bin 130. To further aid in the identification of the contents of sales bin 130, display panel 120 may have a variety of surface treatments.

In an exemplary embodiment depicted in FIG. 1, cherry wood surface treatment 72 is used to indicate premium hardware 70 stored in sales bin 30. In the exemplary embodiment depicted in FIG. 1, maple wood surface treatment 76 is used to indicate basic hardware 74 stored in sales bin 30. The variety of surface treatments for display panel 20 further allows customers to see what premium hardware 70 will look like on a premium surface treatment, and what basic hardware 74 will look like on a basic surface treatment. Further, using contrasting surface treatments to mount a basic product line versus a premium product line provides clarity to a customer of the difference between the two product lines. Further, providing different surface treatments may provide an accent to a more expensive product line. Further still, should a consumer know that they are looking for a less expensive product line, for example, the use of different surface treatments allows a consumer to locate the desired product more rapidly, thereby adding to an enhanced shopping experience which may tend to lead to repeat business for the brand utilizing display 10. According to other alternative embodiments, display panel surface treatment is not limited to cherry wood or maple wood surface. Alternative embodiments may include surface treatments of other premium or basic finishes, surfaces, colors, and materials (e.g., pine, oak, birch, particle board, or other wood products, melamine or other plastic products, aluminum, steel or other metal products).

Figure 5:
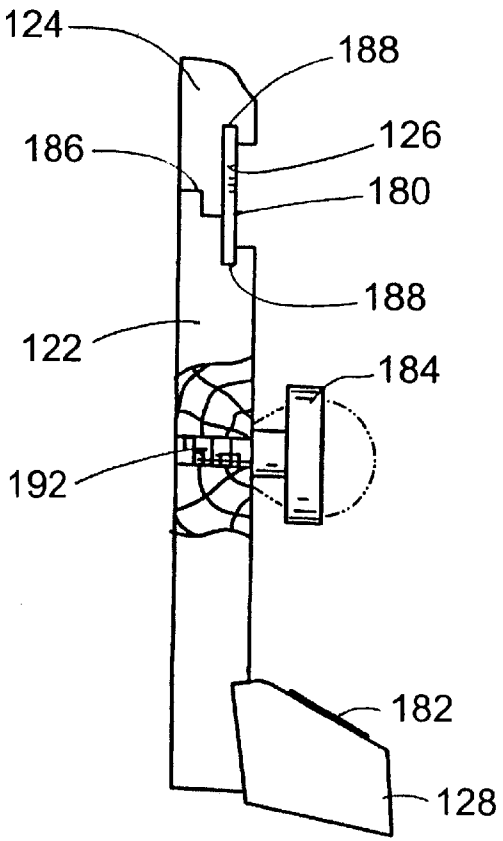
FIG. 5 is a partial fragmentary side elevation view of the display panel of FIG. 4.

FIG. 5 depicts a partial fragmentary side elevational view of display panel 120 according to the exemplary embodiment depicted in FIG. 4. Index trim 124 is coupled to backer 122 by lap joint 186. Grooves 188 are formed in index trim 124 and backer 122, and extends along axis B-B as shown in FIG. 4. Grooves 88 form index slot 126. Index strip 180 is configured to fit into index slot 126. In the exemplary embodiment, knob 184 is attached to backer 122 by threaded shaft 192.

Figure 6:
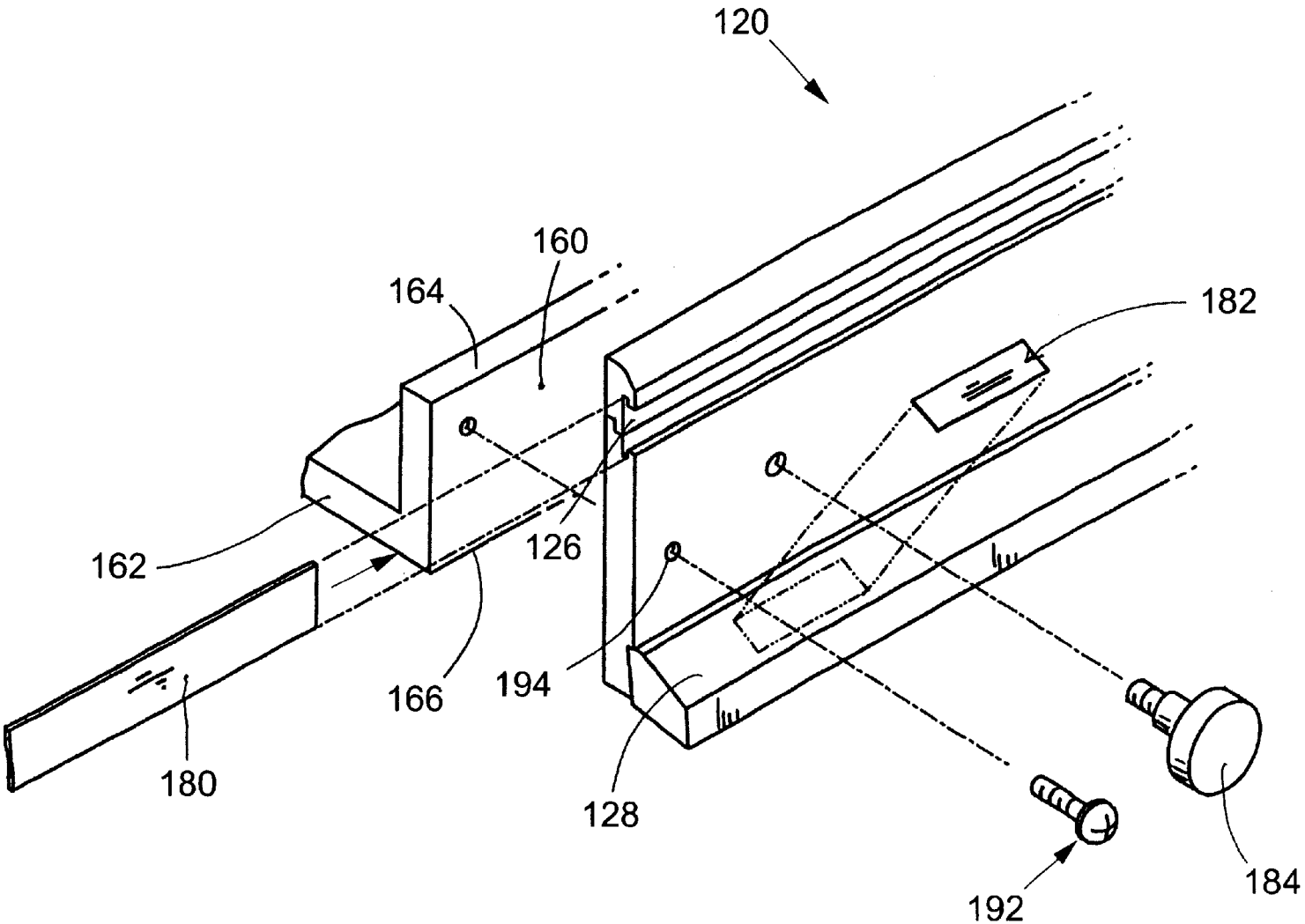
FIG. 6 is a perspective exploded view of the display panel of FIG. 4.

FIG. 6 depicts an exploded view of display panel 120 coupled to mounting frame 160. Mounting frame 160 is attached to floor panel 118. Floor panel 118 and mounting frame 160 attach to side panel 114 along edge 162. A fastener, shown as bolt 192, attaches display panel 120 to mounting frame 160 through aperture 194. Index strip 180 is depicted as slidable into index slot 126. In an exemplary embodiment, indicia, shown as label 182, are attached to ledge trim 128 by an adhesive. However, any of a variety of methods may be used to attach label 182 to ledge trim 128. This configuration allows the merchandised product shown as knob 184 to first be mounted to display panel 120. A variety and variable quantity of merchandised products may be mounted to display panel 120 prior to attaching display panel 120 to mounting frame 160. Being able to mount the merchandised product to display panel 120 prior to attaching display panel 120 to mounting frame 160 allows for ease of configuration and attachment. Mounting merchandised product may be done away from display 110, in a location possibly more convenient than the location of display 110. This configuration also allows for rapid substitutions of an entire display panel 120 with another display panel having different merchandised products or surface treatments.

Figure 8:
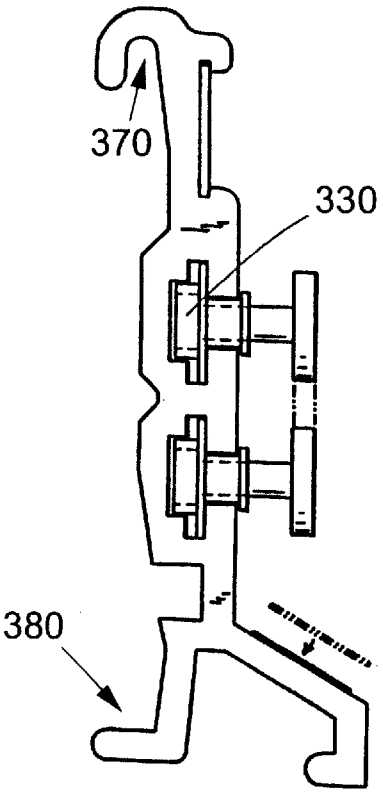
FIG. 8 is a side elevation view of the alternative embodiment of the display panel of FIG. 7.
Figure 7:
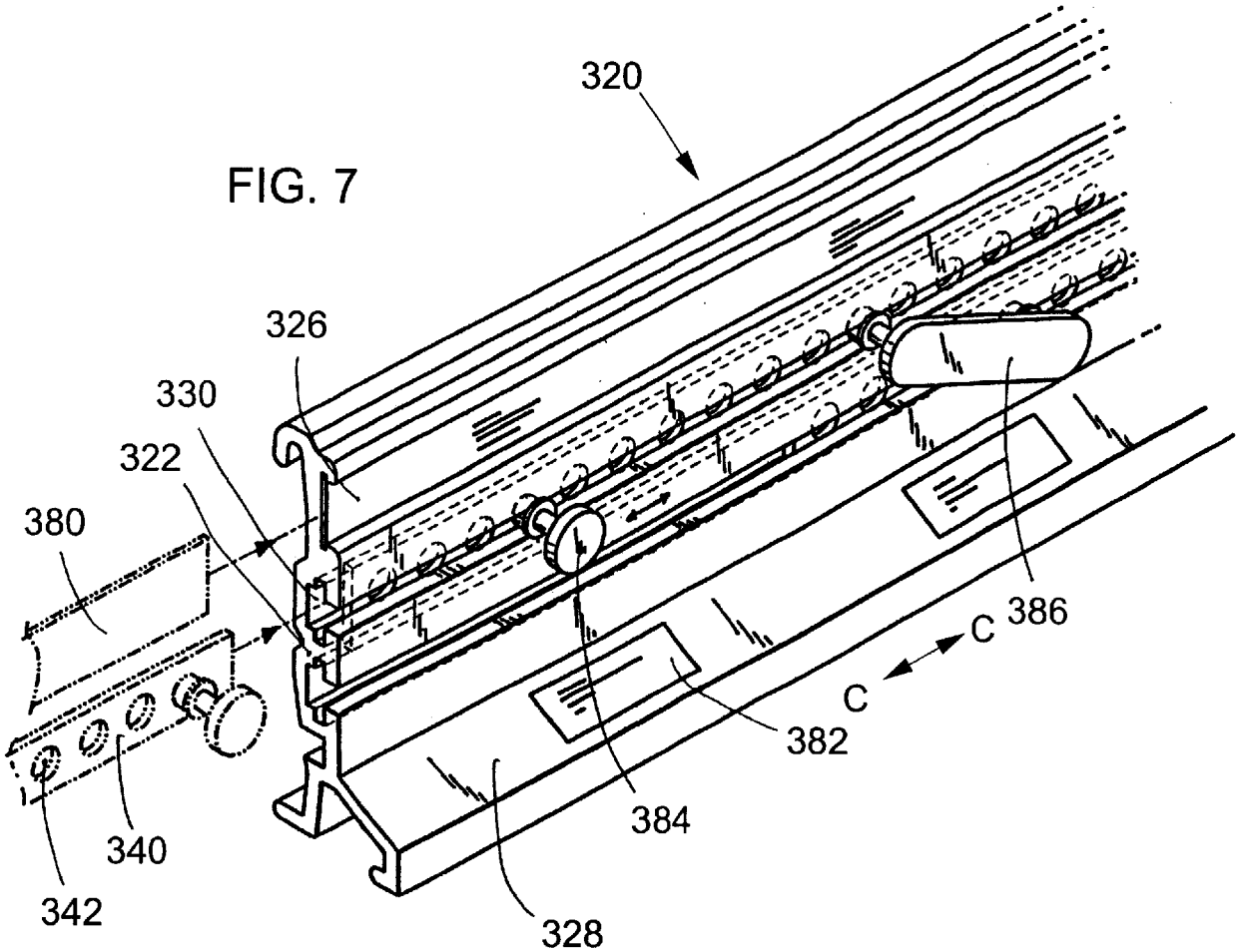
FIG. 7 is a perspective view of an alternative embodiment of a display panel.

FIG. 7 depicts an alternative embodiment of a display panel 320. Display panel 320 includes display slots 330 formed in display panel 320. As shown in FIG. 8, display slot 330 may have a T-shaped cross-section. Referring again to FIG. 7, display slot 330 extends across the full length of display panel 320, along axis C-C. Knobs, pulls and other hardware, shown as knob 384 and pull 386 may be displayed on display panel 320. Knob 384 is attached to rail 340. Rail 340 has a series of through-holes 342 into which knob 384 may be selectively mounted. Placement and orientation of knob 384 can be varied because of the series of through-holes 342 into which knob 384 may be mounted. Rail 340 then slides into the display slot 330. Alternatively merchandised products shown as pull 386 is similarly attached to rails 340. Pull 386 is mounted onto two separate rails 340. Alternatively, pull 386 may be mounted onto the same rail 340. Placement and orientation of pull 386 can be varied because pull 386 may be selectively mounted into the series of through-holes 342. Display panel 320 also includes ledge trim 328 which projects away from body 322 of display panel 320. The angle that ledge trim 328 projects away from body 322 may vary. Label 382 may be attached to ledge trim 328, and are visible to a consumer. Display panel 320 also includes index slot 326. Various descriptions of the displayed product may be printed onto index strip 380, and slid into index slot 326. Alternatively, index strip may be attached to index slot by a variety of attachment means including adhesives and the like.

A variety and variable quantity of merchandised products may be mounted to rail 340 prior to inserting rail 340 into display panel 320. Being able to mount the merchandised product on rail 340 prior to inserting rail into display panel 320 allows for ease of configuration and attachment. Mounting merchandised products may be done away from display 320, in a location possibly more convenient than the location of display 320. Further, the use of rail 340 has the advantage that products mounted in the display will not be moved relative to each other by customers or store personnel.

As shown in FIG. 8, display panel 320 attaches to mounting frame 160 by upper hook 370 and guide 380. Upper hook 370 is hooked around mounting frame upper edge 64. Guide 380 is then secured around mounting frame lower edge 166 (see FIG. 6), thus securing display panel 320 to mounting frame 160, and thereby secured to display 110. Upper hook 370 and guide 380 allows display panel 320 to be readily attached to and removed from mounting frame 160. When display panel 320 is removed from mounting frame 160, rail 340 is easily accessible and may be slid into and out of display panel 320. Easy accessibility to rail 340 allows displayed product to be attached to, removed from and reconfigured on rail 340 without the need to drill new mounting holes in display panel 320. This configuration also allows for rapid substitutions of an entire display panel 320 with another display panel having different merchandised products or surface treatments by easily hooking onto mounting frame 160. In an alternative embodiment, display panel 320 may be mounted to frame 160 in a variety of ways including, but not limited to screws, slots, and other fasteners or hangers.

Figure 10:
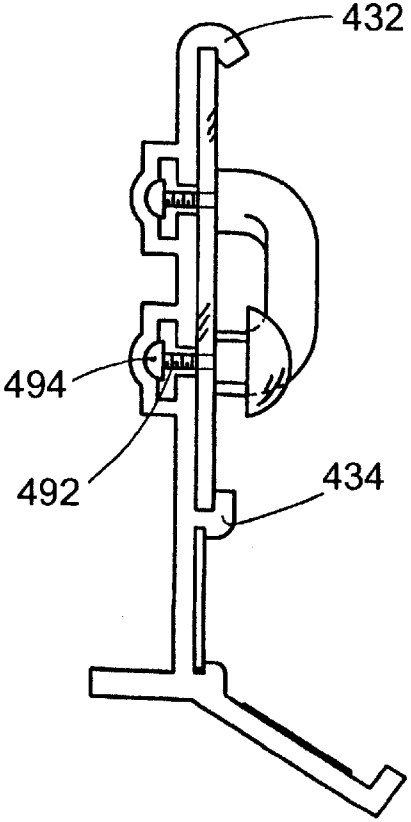
FIG. 10 is a side elevation view of the alternative embodiment of the display panel of FIG. 9.
Figure 9:
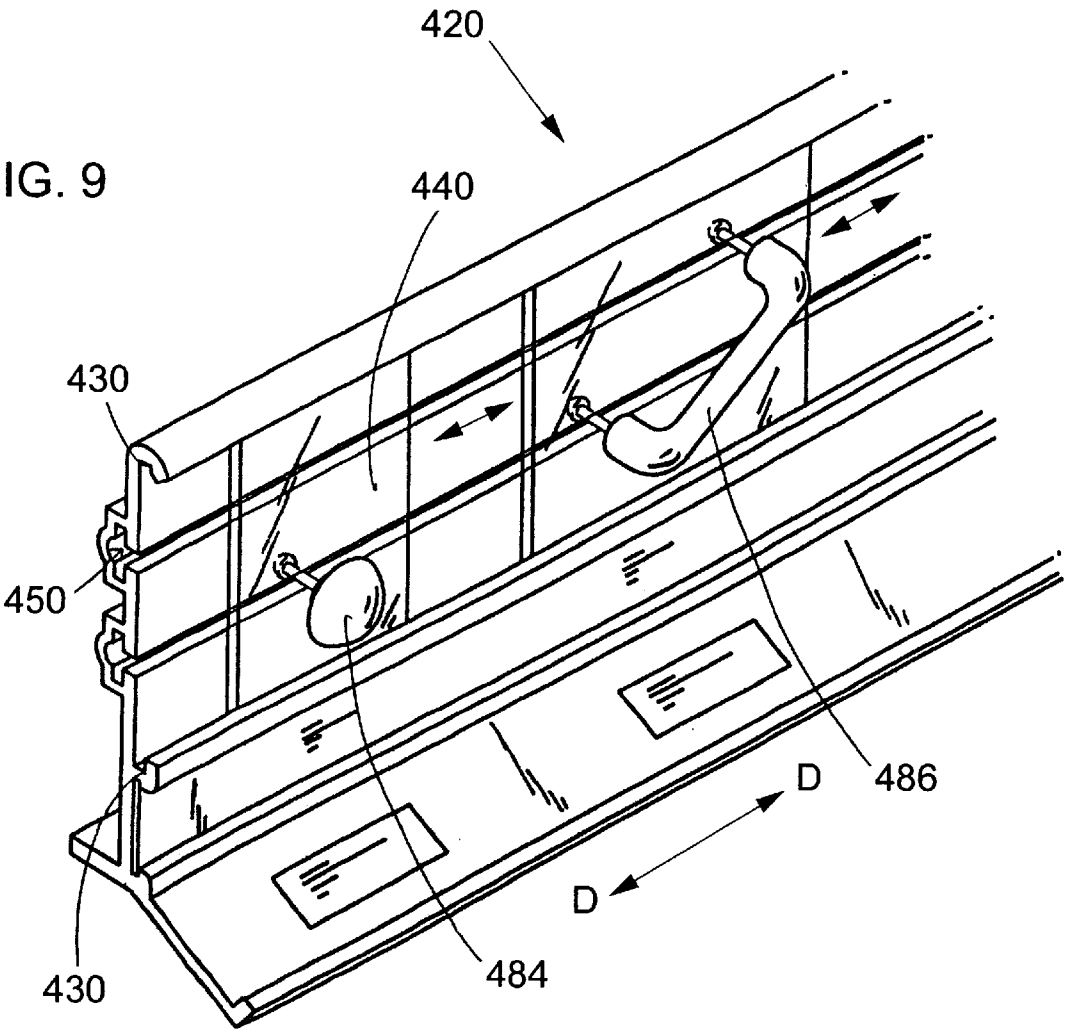
FIG. 9 is a perspective view of an alternative embodiment of a display panel.

FIGS. 9 and 10 depict another alternative embodiment of a display panel 420. Display panel 420 includes mounting card 440. Mounting card 440 is configured to slideably fit into channels 430. Channels 430 are formed by upper channel hook 432 and lower channel hook 434, as shown in FIG. 10. Knob 484 or pull 486 is attached to mounting card 440 with fasteners shown as screw 492. Screw head 494 fits into retainer slot 450, allowing mounting card 440 to slide in channels 436. When display panel 420 is removed from mounting frame 160, mounting card 440 is easily accessible. Easy accessibility to mounting card 440 allows displayed product to be attached to, removed from and reconfigured on mounting card 440 without the need to drill new mounting holes in display panel 420. Mounting card 440, sliding in channel 430, allows for easy configuration and placement of knob 484 or pull 486 along axis D-D. Furthermore, when display panel 420 is removed from mounting frame 160, mounting card 440 may be easily slid into, and out of channels 430. When mounting card 440 is removed from channels 430 displayed product may be easily attached to and removed from mounting card, further allowing for easy reconfiguration and placement of displayed product.

Figure 12:
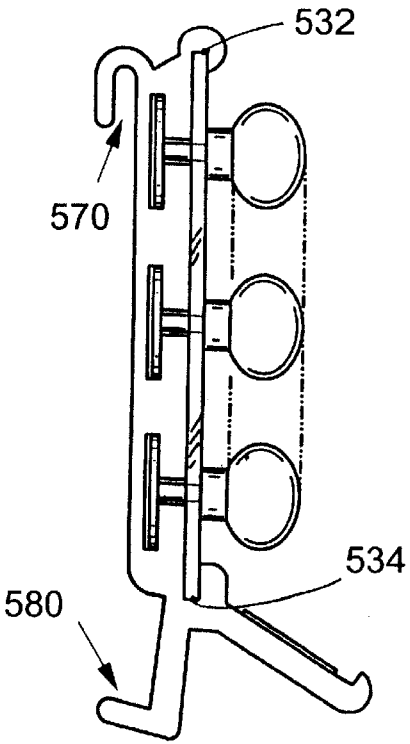
FIG. 12 is a side elevation view of the alternative embodiment of the display panel of FIG. 11.

Display panel 420 may be attached to mounting frame 160 by a variety of attachment methods including adhesives, screws and other fasteners, or hooks as shown in FIG. 8 and 12.

Figure 11:
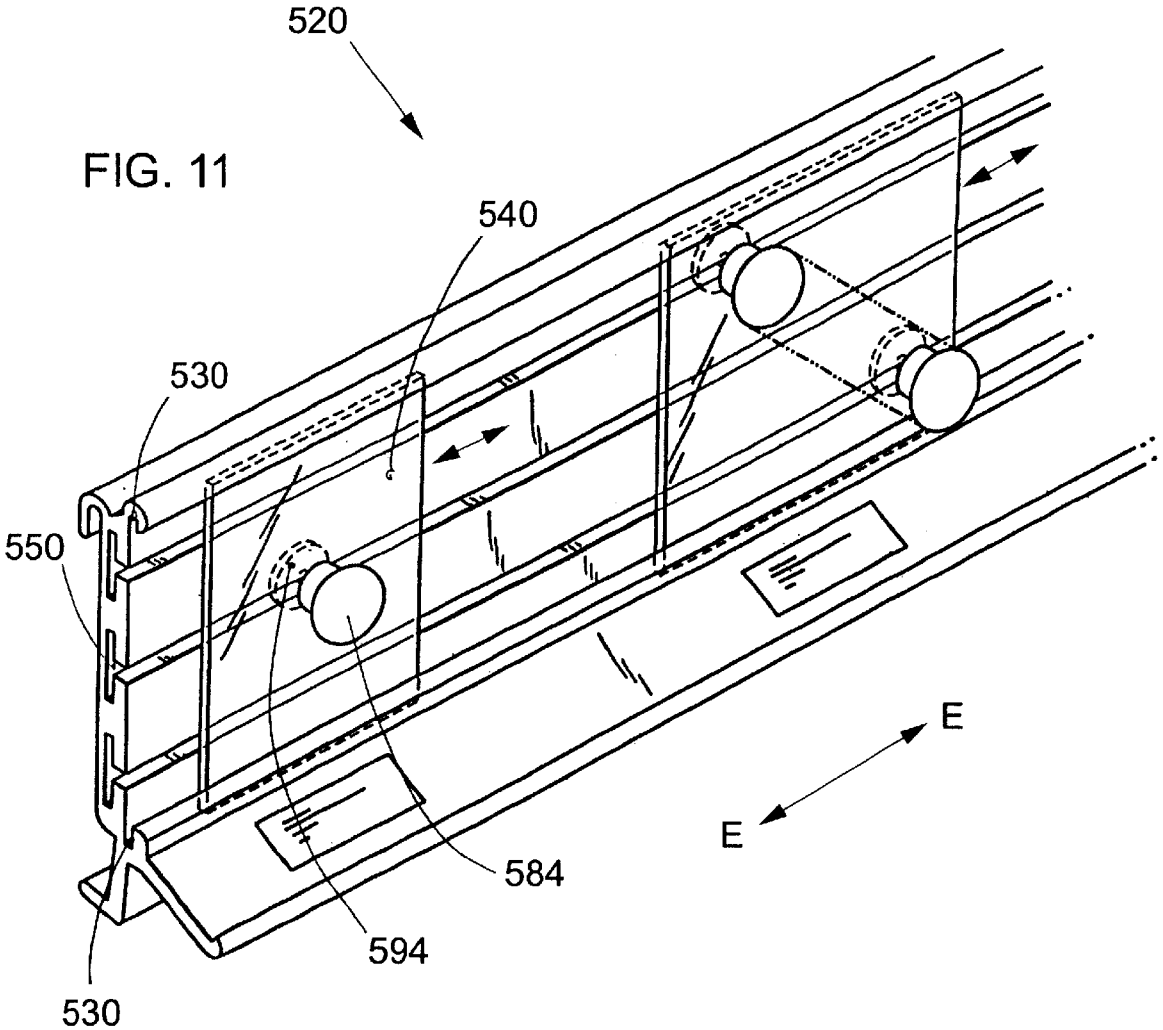
FIG. 11 is a perspective view of an alternative embodiment of the display panel.

FIGS. 11 and 12 depict yet another exemplary embodiment of a display panel 520. Display panel 520 includes a plurality of retainer slots 550. Retainer slot 550 is integrally formed into display panel 520, extends along the axis E-E of display panel 520, and is cross-sectionally T-shaped. Knob 584 is mounted onto mounting card 540. Retainer 594 is attached to knob 584 and is configured to fit into slot 550. Mounting card 540 is configured to slideably fit into channels 530. Channels 530 are formed by upper channel slot 532 and lower channel slot 534, as shown in FIG. 12.

Referring to FIG. 12 and FIG. 6, display panel 520 attaches to mounting frame 160 by upper hook 570 and guide 580. Upper hook 570 is hooked around mounting frame upper edge 164. Guide 580 is then secured around mounting frame lower edge 166, thus securing display panel 520 to mounting frame 160, and thereby secured to display 110. Upper hook 570 and guide 580 allows display panel 520 to be readily attached to and removed from mounting frame 160. When display panel 520 is removed from mounting frame 160, mounting card 540 is easily accessible. Easy accessibility to mounting card 540 allows displayed product to be attached to, removed from and reconfigured on mounting card 540 without the need to drill new mounting holes in display panel 520. Mounting card 540 sliding in channels 530 allows for easy configuration and placement of knob 584 along axis E-E. Furthermore, when display panel 520 is removed from mounting frame 160, mounting card 540 may be easily slid into, and out of channels 530. When mounting card 540 is removed from channels 530, displayed product may be easily attached to and removed from mounting card 540, further allowing for easy reconfiguration and placement of displayed product.

Figure 15:
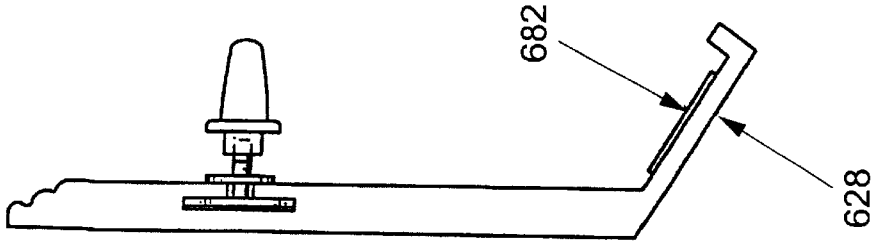
FIG. 15 is a side elevation view of the alternative embodiment of the display panel of FIG. 14.
Figure 13:
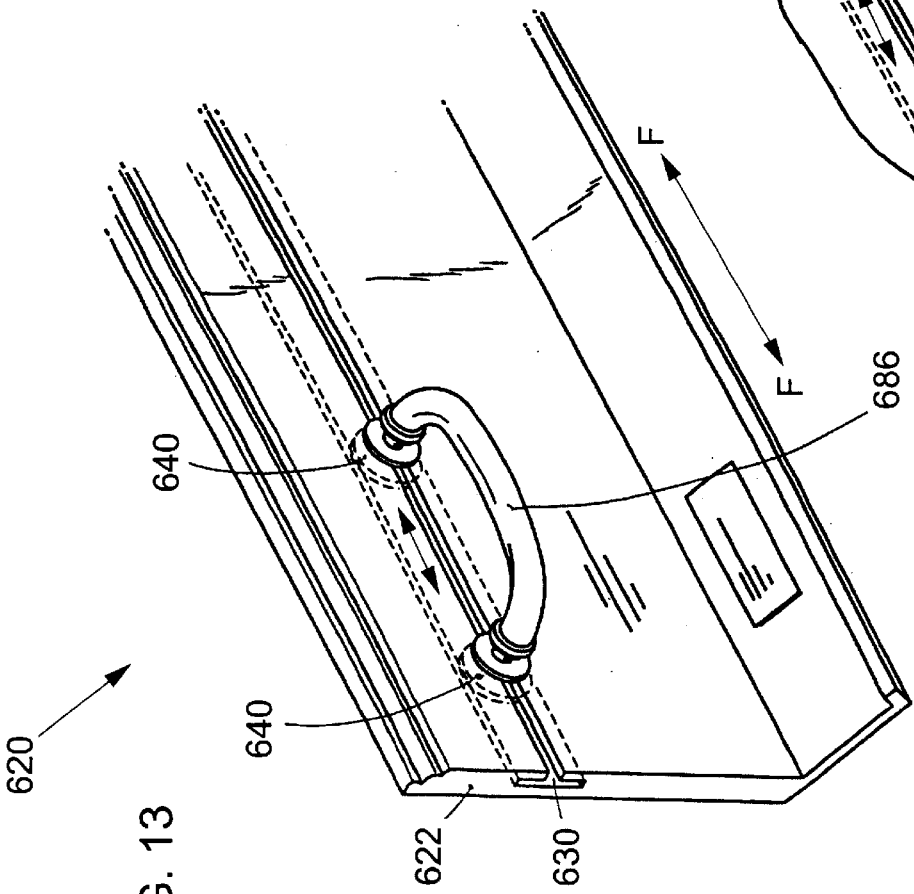
FIG. 13 is a perspective view of an alternative embodiment of a display panel.

FIG. 13 depicts yet another exemplary embodiment of display panel 620. Display panel 620 includes display slot 630 formed in body 622. As shown in FIG. 15, display slot 630 may have a T-shaped cross-section. Referring again to FIG. 13, display slot 630 extends across the full length of display panel 620, along axis F-F. Knobs, pulls and other hardware, shown as pull 686 may be displayed on display panel 620. Pull 686 is attached to retainers 640. Retainers 640 then slide into the display slot 630. Placement and orientation of pull 686 can be varied relative to display panel 620 by sliding pull 686 and retainers 640 along axis F-F.

As shown in FIG. 15 display panel 620 also includes ledge trim 628 which projects away from body 622 of display panel 620. The angle that ledge trim 628 projects away from body 622 may vary. Label 682 may be attached to ledge trim 628, and is visible to a consumer.

A variety and variable quantity of merchandised products may be mounted to multiple retainers 640 prior to inserting retainers 640 into display panel 620. Being able to mount the merchandised product on retainers 640 prior to inserting retainers 640 into display panel 620 allows for ease of configuration and attachment. Mounting merchandised products may be done away from display 10, in a location possibly more convenient than the location of display 10.

Display panel 620 may be attached to mounting frame 160 by a variety of attachment methods including adhesives, screws and other fasteners, or upper hooks and guides as shown in FIG. 8 and 12.

Figure 14:
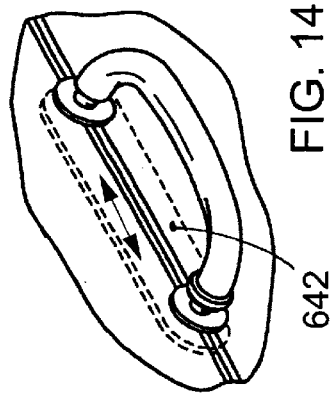
FIG. 14 is a partial perspective view of a product mounted using an alternative retainer.

FIG. 14 depicts an alternative embodiment of the retainers shown in FIG. 13. Retainers 640 may alternatively be a single body retainer 642 configured to slide into and fit display slot 630.

While the detailed drawings, specific examples, and particular formulations given describe exemplary embodiments, they serve the purpose of illustration only. The materials and configurations shown and described may differ depending on the chosen display characteristics and physical characteristics of the displays. For example, the type of display panel coupling used may differ. The display systems shown and described are not limited to the precise details and conditions disclosed. Furthermore, other substitutions, modifications, changes, and omissions may be made in the design, operating conditions, and arrangement of the exemplary embodiments without departing from the scope of the invention as expressed in the appended claims.

What is claimed is:

1. A display far merchandising products comprising:

a base panel;

two side panels coupled to the base panel;

a top panel coupled to the two side panels;

at least one display panel disposed between the two side panels, the at least one display panel being configured to receive products; and a hook provided on the at least one display panel wherein the at least one display panel is configured to be removably coupled to the display.

2. The display of claim 1 wherein the different surface treatments correspond to different product quality of the product lines.

3. The display of claim 1 wherein at least one surface treatment is a premium wood finish.

4. The display of claim 3 wherein at least one surface treatment is a basic wood finish.

5. The display of claim 4 wherein the basic wood finish is associated with a basic grade product.

6. The display of claim 3 wherein the premium wood finish is associated with a premium grade product.

7. The display of claim 1 wherein the different surface treatments correspond to different product prices of the product lines.

8. The display of claim 1 wherein the different surface treatment corresponds to different product style of the product lines.

9. The display of claim 1 wherein the products include cabinet hardware products.

10. The display of claim 9 wherein the cabinet hardware include cabinet knobs.

11. The display of claim 9 wherein the cabinet hardware include cabinet hinges.

12. A display panel for mounting and displaying merchandised products on a display, the display panel comprising:

a panel body configured to be removably coupled to the display; and at least one retainer slidably coupled to the panel body, wherein the retainer is configured to be coupled to the merchandised product.

13. The display panel of claim 12 wherein the panel body is removably coupled to the display by at least one hook.

14. The display panel of claim 12 wherein the panel body is removably coupled to the display by an upper hook and a guide.

15. The display panel of claim 12 further comprising:

a slot formed in the panel body;

wherein the slot is configured to receive the retainer.

16. The display panel of claim 12 wherein an individual merchandised product is coupled to an individual retainer.

17. The display panel of claim 12 wherein multiple merchandised products are coupled to an individual retainer.

18. The display panel of claim 12 wherein an individual merchandised product is coupled to multiple retainers.

19. The display panel of claim 12 wherein the panel body includes a ledge configured to receive indicia.

20. The display panel of claim 12 wherein the panel body includes an index slot configured to receive indicia.

21. The display panel of claim 12 wherein the retainer is a bar having a plurality of apertures configured to retain products in different locations.

22. The display panel of claim 12 wherein the panel is configured to have a surface treatment.

23. The display panel of claim 22 wherein the surface treatment is a premium wood finish.

24. The display panel of claim 22 wherein the surface treatment is a basic wood finish.

25. A display for merchandising products, the display comprising:

a base panel;

two side panels coupled to the base panel;

a top panel coupled to the two side panels;

a plurality of display panels disposed between the two side panels, the display panels having surface treatments, at least two display panels having different surface treatments;

the display panel including a panel body, the panel body configured to be removably coupled to the display;

at least one retainer slidably coupled to the panel body, wherein the retainer is configured to be coupled to the merchandised product.

26. The display of claim 25 wherein the panel body is removably coupled to the display by at least one hook.

27. The display of claim 26 wherein the panel body is removably coupled to the display by an upper hook and a guide.

28. The display of claim 25 further comprising:

a slot formed in the panel body;

wherein the slot is configured to receive the retainer.

29. The display of claim 25 wherein an individual merchandised product is coupled to an individual retainer.

30. The display of claim 25 wherein multiple merchandised products are coupled to an individual retainer.

31. The display of claim 25 wherein an individual merchandised product is coupled to multiple retainers.

32. The display of claim 25 wherein the panel body includes a ledge configured to receive indicia.

33. The display of claim 25 wherein the panel body includes an index slot configured to receive indicia.

34. The display of claim 25 wherein the retainer is a bar having a plurality of apertures configured to retain products in different locations.

35. The display panel of claim 25 wherein at least one surface treatment is a premium wood finish.

36. The display panel of claim 25 wherein at least one surface treatment is a basic wood finish.

37. The display of claim 1, wherein the display panels each have a surface treatment, at least two display panels having different surface treatments and the different surface treatments being configured to be associated with different product lines.

* * * * *